US011495196B2

(12) United States Patent
Warmac

(10) Patent No.: US 11,495,196 B2
(45) Date of Patent: Nov. 8, 2022

(54) GUITAR ARMREST

(71) Applicant: Edward Warmac, Vancouver, WA (US)

(72) Inventor: Edward Warmac, Vancouver, WA (US)

( * ) Notice: Subject to any disclaimer, the term of this patent is extended or adjusted under 35 U.S.C. 154(b) by 0 days.

(21) Appl. No.: 17/497,763

(22) Filed: Oct. 8, 2021

(65) Prior Publication Data

US 2022/0044659 A1 Feb. 10, 2022

Related U.S. Application Data

(63) Continuation-in-part of application No. 17/179,034, filed on Feb. 18, 2021, now abandoned.

(60) Provisional application No. 62/983,447, filed on Feb. 28, 2020.

(51) Int. Cl.
*G10D 3/18* (2020.01)

(52) U.S. Cl.
CPC ..... *G10D 3/18* (2013.01)

(58) Field of Classification Search
CPC ..... G10D 3/18
See application file for complete search history.

(56) References Cited

U.S. PATENT DOCUMENTS 9,196,233 B2 * 11/2015 Schulze ..... G10D 3/18
2003/0029961 A1 * 2/2003 Hollinger ..... A47K 10/3836 242/597.7

OTHER PUBLICATIONS

Legendary PLAYWOOD Armrest Guitar Support, 2018, https://www.facebook.com/pg/Playwoood/posts/, viewed on Jan. 12, 2022 (Year: 2018).*

Dan Cunningham, Acoustic Guitar Armrests—Andreas Abel Armauflage and Saddle-A-Bout, https://www.youtube.com/watch?v=83L4VOHJ3VU (Year: 2017).*

* cited by examiner

*Primary Examiner* — Jianchun Qin
(74) *Attorney, Agent, or Firm* — Mark S Hubert

(57) ABSTRACT

A guitar armrest designed to relieve the arm stress that a guitarist experiences in the Palmaris Longus muscle caused by the arm resting against the acoustic guitar's lower bout and soundboard side edge. It is made of a one piece injection-molded flexible rubber solid body, with a durometer so as to hold the weight of a guitarist's arm off of the front soundboard so as to prevent scratching and deadening of the sound projected therefrom. Replaceable suction cups extend through the body of the armrest such that their attachment buttons protrude from the armrest's top face and their suction disks protrude from the bottom face. The armrest is temporarily affixed to the lower bout of the guitar by suction means.

9 Claims, 6 Drawing Sheets

FIG.13
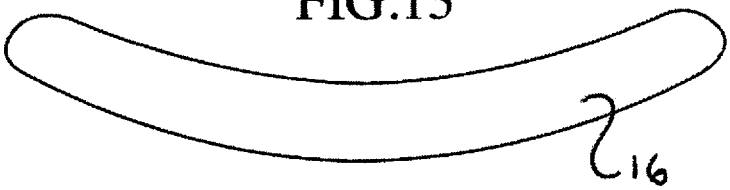
FIG. 14
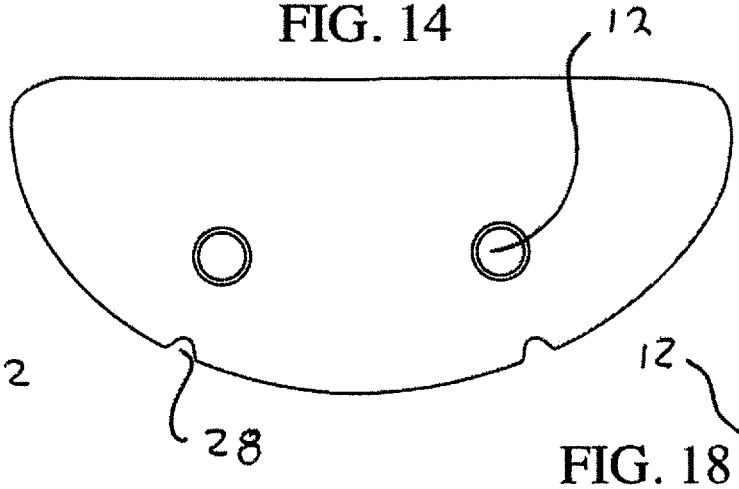
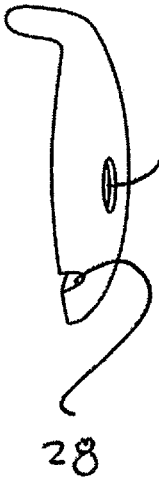
FIG. 17
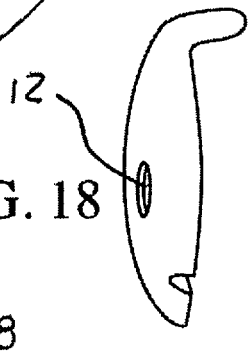
FIG. 18
FIG.15
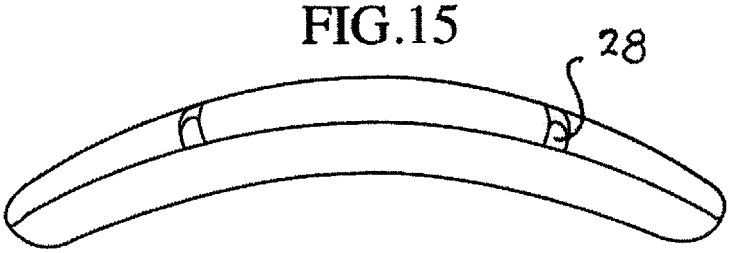
FIG. 16
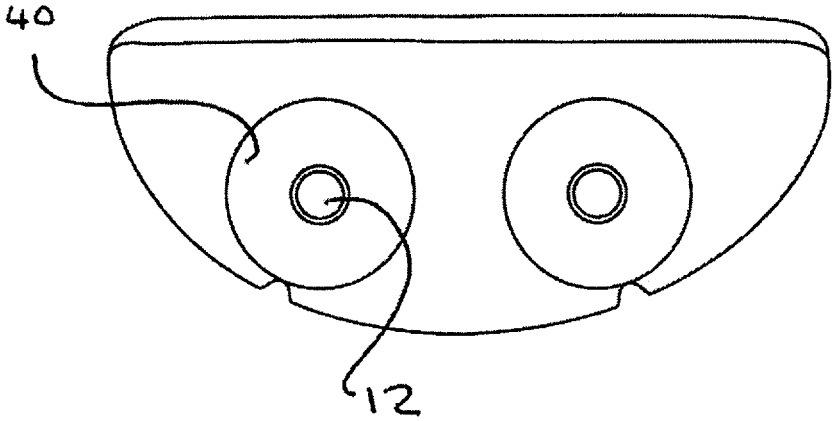

GUITAR ARMREST

CROSS-REFERENCE TO RELATED APPLICATIONS

This continuation-in-part application claims the benefit of U.S. Provisional Patent Application No. 62/983,447, filed Feb. 28, 2020, and U.S. Utility patent application Ser. No. 17/179,034 filed Feb. 18, 2021, both of which are incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to accessories for acoustic guitars to enhance the guitarist's comfort when playing for extended periods.

BACKGROUND

Guitarists playing for extended periods of time often experience a reduction in blood circulation causing hand/arm numbness, and/or general discomfort of the Palmaris Longus muscle caused by resting their arm against the 90 degree edge located between the lower bout and the front face of the acoustic guitar's soundboard. The continuous pressure and movement exerted while playing exacerbates the situation.

Devices have been developed to pad this area but to date the prior art guitar armrests have required elaborate attachment systems, were not useable for both right hand and left hand guitarists, slid along the side of the guitar, were not conformable to various diameter lower bouts, were not conformable to the various soundboard dome radius, marked or marred the guitar's surface finish, were not washable, cut off the flow of blood to the guitarist's arm, were expensive and did not have commonly available replacement components. However, the most restrictive problem with most prior art guitar armrests is that they all put pressure onto the soundboard, which is essentially the sound pump for the guitar. Restricting the movement of the soundboard affects the volume, tone and response time of the guitar's sound.

Henceforth, an inexpensive guitar armrest that attaches simply and firmly to a left or right strung acoustic guitar without damaging the guitar's finish and restricting the movement of the soundboard, would fulfill a long felt need in the acoustic guitar accessory industry. This new invention utilizes and combines known and new technologies in a unique and novel configuration to overcome the aforementioned problems and accomplish this.

BRIEF SUMMARY

In accordance with various embodiments, an acoustic guitar armrest is provided that does not affect the sound pumping ability of the guitar's soundboard or that does not cut off the flow of blood to the guitarist's arm.

In one aspect, an armrest for an acoustic guitar that quickly and simply attaches to a plethora of different sized lower bouts.

In another aspect, an armrest for an acoustic guitar that is washable and capable for attachment to a left or right strung acoustic guitar.

In yet another aspect, an armrest for an acoustic guitar that has off the shelf replacement components.

In yet another aspect, an unbreakable armrest for an acoustic guitar that can be easily adjusted along the lower bout and is conformed for soundboards of different dome radiuses.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 13 is a front view of a guitar armrest without suction cups;

FIG. 14 is a top view of a guitar armrest without suction cups;

FIG. 15 is a back view of a guitar armrest without suction cups;

FIG. 16 is a bottom view of a guitar armrest without suction cups;

FIG. 17 is a right end view of a guitar armrest without suction cups;

FIG. 18 is a left end view of a guitar armrest without suction cups;

DETAILED DESCRIPTION OF CERTAIN EMBODIMENTS

Figure 1:
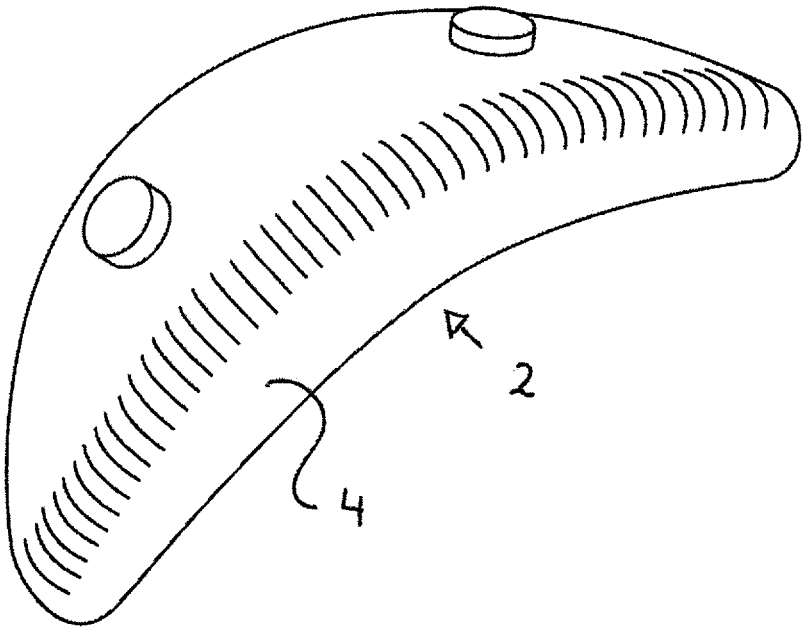
FIG. 1 is a side perspective view of a guitar armrest.
Figure 2:
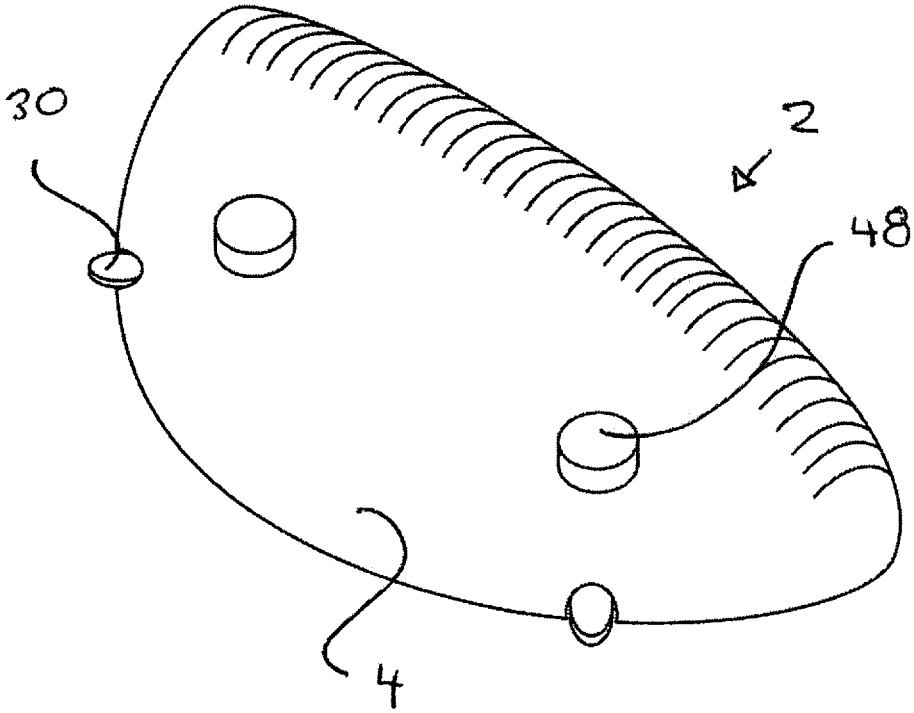
FIG. 2 is a top perspective view of a guitar armrest.
Figure 3:
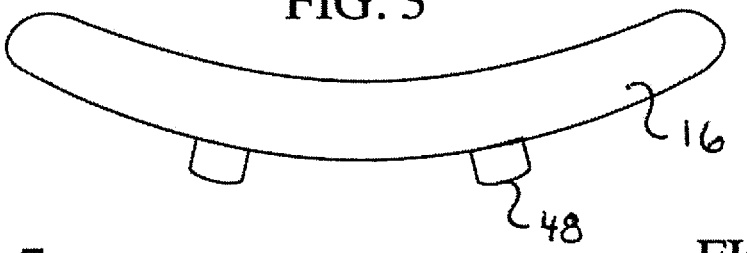
FIG. 3 is a front view of a guitar armrest.
Figure 7:
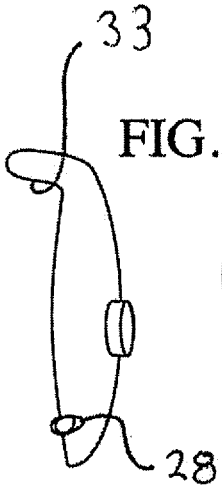
FIG. 7 is a right end view of a guitar armrest.
Figure 4:
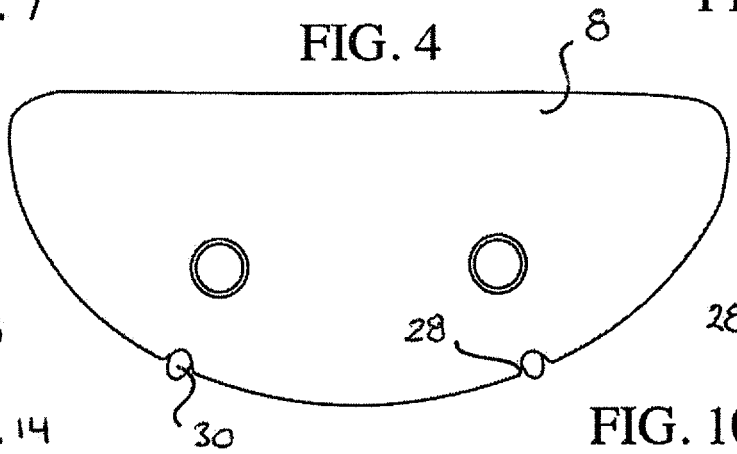
FIG. 4 is a top view of a guitar armrest.
Figure 8:
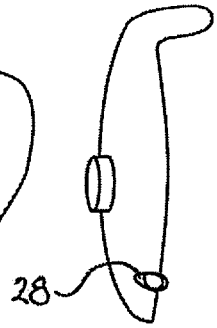
FIG. 8 is a left end view of a guitar armrest.
Figure 9:
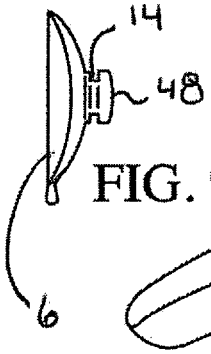
FIG. 9 is a side view of the first suction cup.
Figure 5:
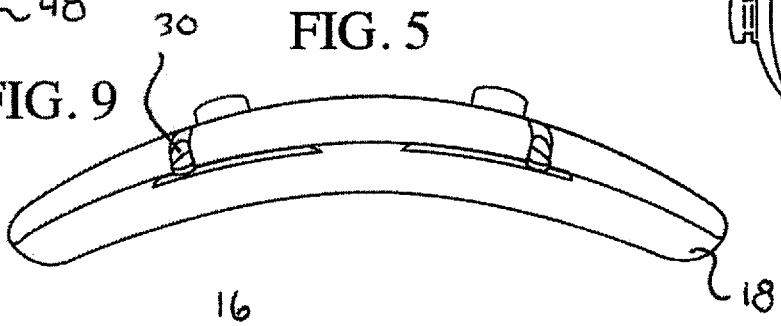
FIG. 5 is a back view of a guitar armrest.
Figure 10:
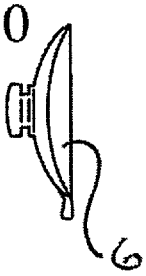
FIG. 10 is a side view of the second suction cup.
Figure 6:
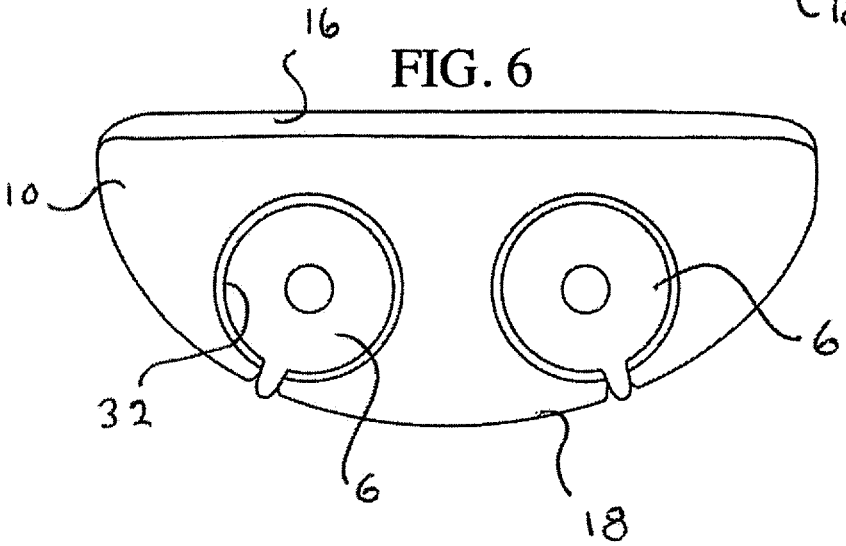
FIG. 6 is a bottom view of a guitar armrest.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features and/or components, but do not preclude the presence or addition of one or more other features, or components.

The present invention relates to a novel design for an acoustic guitar armrest. In contrast to other prior art guitar armrests, this armrest does not affect the sound quality of the guitar by putting any pressure on the soundboard that restricts its vibrational "sound pumping" feature, and does not put the guitarist's arm to sleep.

In the way of background, the guitar is a musical instrument where a set of different diameter strings resides in tension atop of a hollow body, centered over a sound hole in the top face (soundboard) of the hollow body. The strings themselves make little noise because they are thin and slip easily through the air without making much of a disturbance in the air. In an acoustic guitar, the vibration of the strings is transferred via the bridge and saddle to the soundboard of the guitar. The body transmits the vibration of the bridge into vibration of the air around it, by pumping a reasonable amount of air backwards and forwards. The soundboard is made so that it can vibrate up and down relatively easily. As it does this some of this air flows outwards, compressing the next layer of air. This disturbance in the air spreads out as a travelling sound wave which ultimately causes a very tiny vibration to the eardrum and is interpreted as a sound. The back plate and sides of the guitar body are much less important acoustically for most frequencies, because they is held against the player's body and do not vibrate much. Thus, most of the sound coming from an acoustic guitar is due to the pumping motion of the soundboard.

Figure 25:
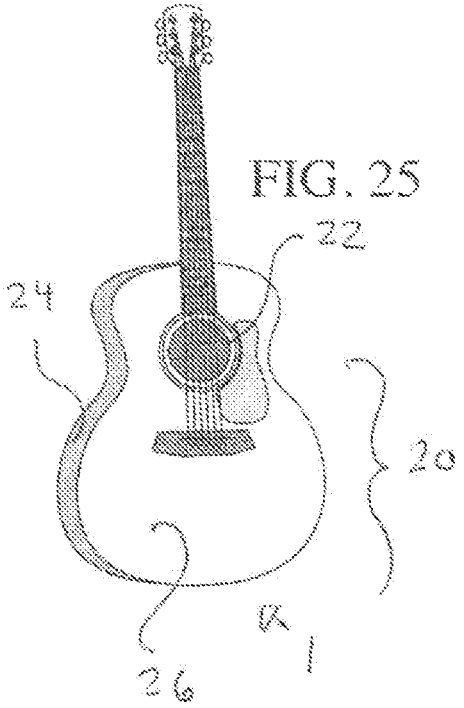
FIG. 25 is a front perspective view of an acoustic guitar.
Figure 26:
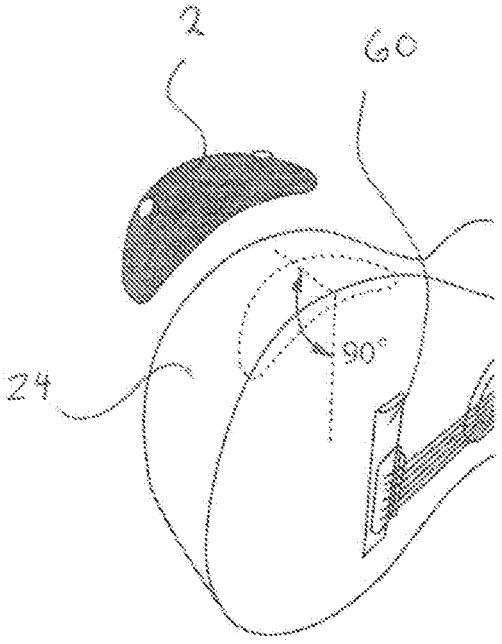
FIG. 26 is a front perspective view of an acoustic guitar's lower bout showing the proposed location for the installation of the guitar armrest.
Figure 27:
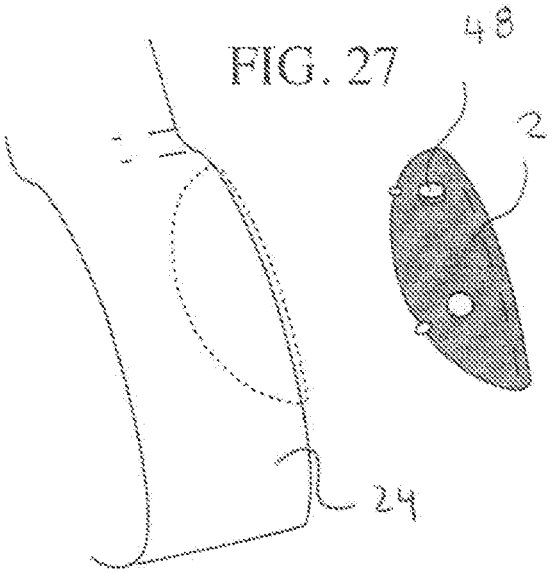
FIG. 27 is a side perspective of an acoustic guitar's lower bout and the proposed location of the guitar armrest.
Figure 28:
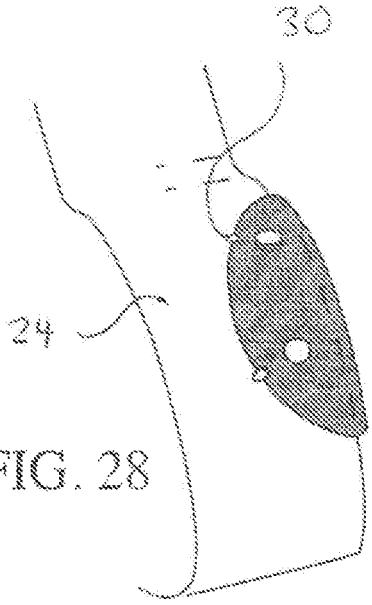
FIG. 28 is a side perspective of an acoustic guitar with the guitar armrest installed.

Guitar players rest their arm across the side 24 of the lower bout 20 (widest and lowest part of the guitar body 1) and the 90 degree edge where the side 24 meets the soundboard 26. (See FIG. 25) For most players, the strumming/picking forearm (Palmaris Longus muscle) is constantly resting on, and rubbing against these two perpendicular surfaces of the acoustic guitar 1. Because of this sharp angle, prolonged resting at this position causes the reduction in blood circulation causing hand or arm numbness, and general discomfort of this Palmaris Longus muscle leading to a loss of dexterity and stamina. Additionally, the contact between the forearm and the soundboard 26 slightly reduces the frequency the soundboard 26 can produce, and deadens the volume of the sound that comes from the sound hole 22 and off of the soundboard 26.

The preferred embodiment of the guitar arm rest 2 can best be seen in FIGS. 1-10. Here it can be seen that the guitar arm rest 2 is comprised of three parts, a flexible, solid body 4 and a pair of replaceable suction cups 6 that are removably affixed into the body 4 so as to extend between the top face 8 of the body and the bottom face 10 of the body. (Although depicted herein the preferred embodiment with two identical suction cups, it is envisioned a single, larger suction cup or a series of multiple, smaller suction cups may replace these two identical suction cups with comparable adhesion.)

Herein, as disclosed, the limitations of the guitar arm rest, specifically, the 95 degree included angle between the concave bottom inner face 10 of the top panel, and the inner face of the front panel 16, combined with the rest's specified durometer range of 60-65 on the Shore A scale of hardness, the selection of a natural or synthetic rubber as the material of construction, and lastly, the radius formed at the outer edge of the front panel 16 where it interfaces with the convex top face 8 of the top panel, synergistically enable the novel features that are not found in any of the prior art guitar armrests. First, it allows the rest to contour (if necessary) to the curvature of the side 24 of different shaped guitars to prevent slippage. Second, it allows the front panel 16 to be kept off of the guitar soundboard to prevent scratching the guitar as well as affecting its sound frequencies. Thirdly, and most importantly, it creates a comfortable, edge that is not sharp enough to cut off the flow of blood to the guitarist's arm.

The body 4 is a domed, semi-circular solid disk having a top panel 5 with a convex top, (outer) face 8, a concave bottom, (inner) face 10 and an arced front panel 16 with an arced front edge 13, where the front panel 16 extends almost perpendicularly at 95 degrees from the concave bottom face 10 of the top panel 5. (FIGS. 1 and 6) The inner face 33 of the front panel 16 is planar. The outer face of the front panel 16 is planar but radiused where it interfaces with the convex top face 8. The perimeter of the back edge 18 is semi-circular such that when the convex top face 8 is viewed from above, the body has a D shaped configuration. In the perimeter of the back edge 18 are two C shaped suction release notches 28 spaced equidistant from the axial centerline of the body 4. Protruding radially outward from the suction release notches 28 are the suction release tabs 30 which extend from the outer perimeter edge 32 of the suction cups 6. The body is a flexible polymer simplifying fabrication and keeping costs down. Preferably the polymer will be a natural or synthetic rubber.

The body itself is a unitary injection molded, solid, flexible polymer body. It has an approximate hardness measured at a durometer of 60-65 on the Shore A scale of hardness. This is an important selection in the range of hardness, as the body 4 of the armrest 2 must be able to contour to the radius of the lower bouts 20 of different sized and shaped guitars and yet prevent the front panel 16 from contacting the soundboards of different shaped guitar bouts.

Figure 11:
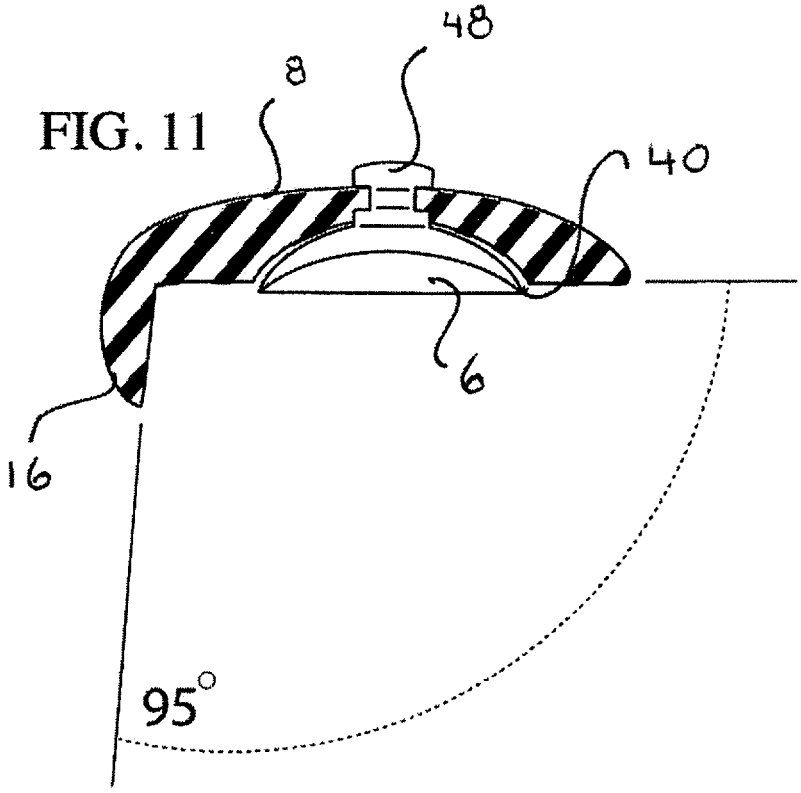
FIG. 11 is a right end cross sectional view of the guitar armrest.
Figure 12:
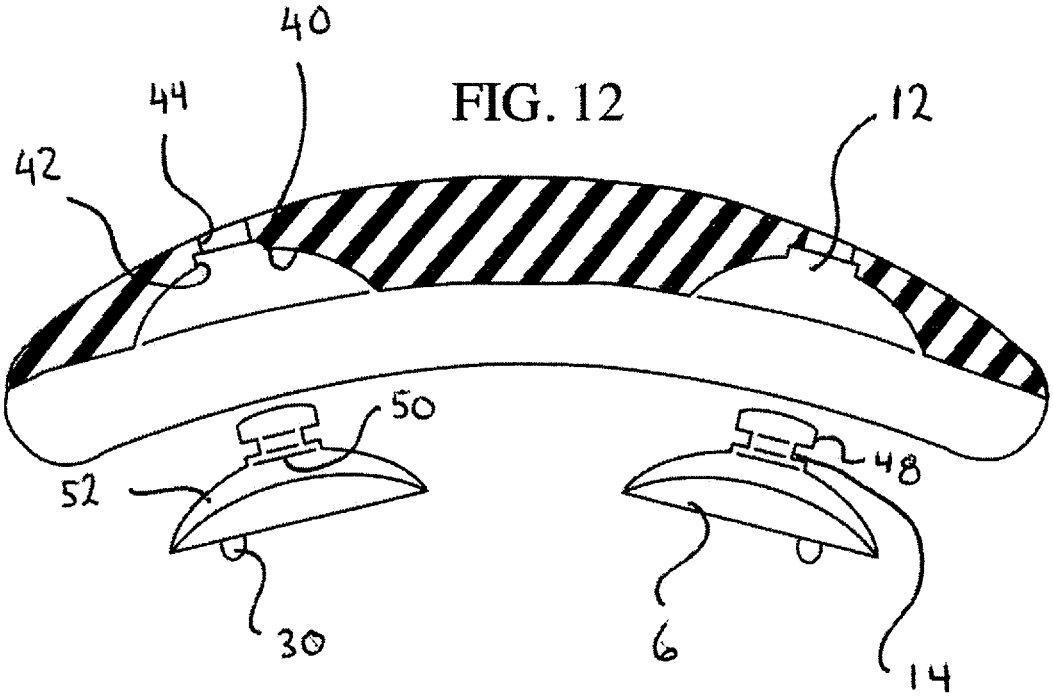
FIG. 12 is a back cross sectional view of the guitar armrest.
Figure 19:
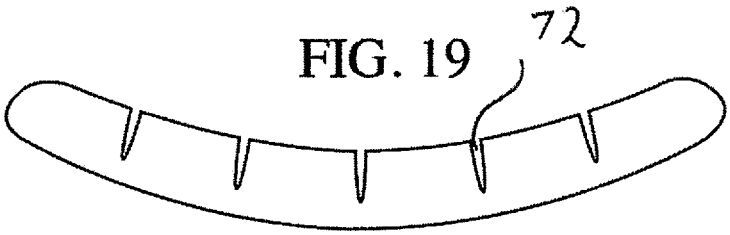
FIG. 19 is a front view of an alternate embodiment guitar armrest body
Figure 20:
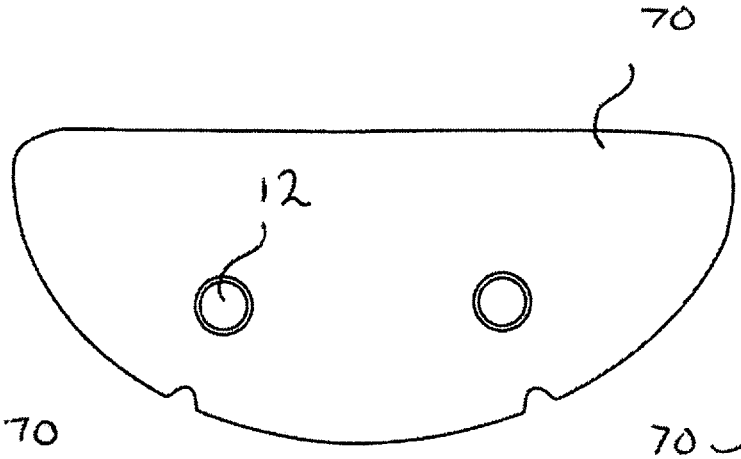
FIG. 20 is a top view of an alternate embodiment guitar armrest body.
Figure 23:
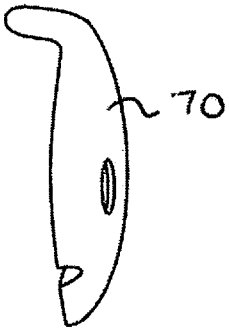
FIG. 23 is a left-side view of an alternate embodiment guitar armrest body.
Figure 24:
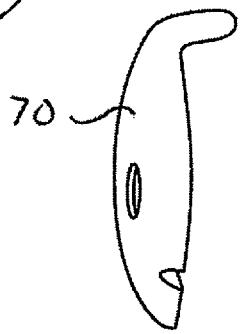
FIG. 24 is a right-side view of an alternate embodiment guitar armrest body.
Figure 21:
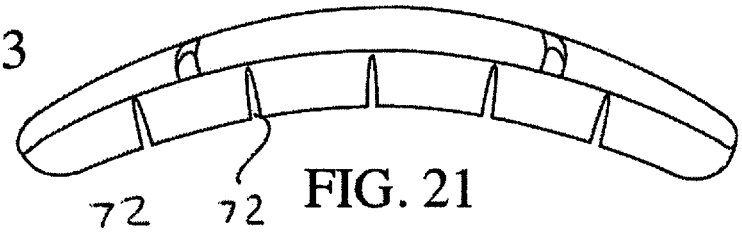
FIG. 21 is a front view of an alternate embodiment guitar armrest body.
Figure 22:
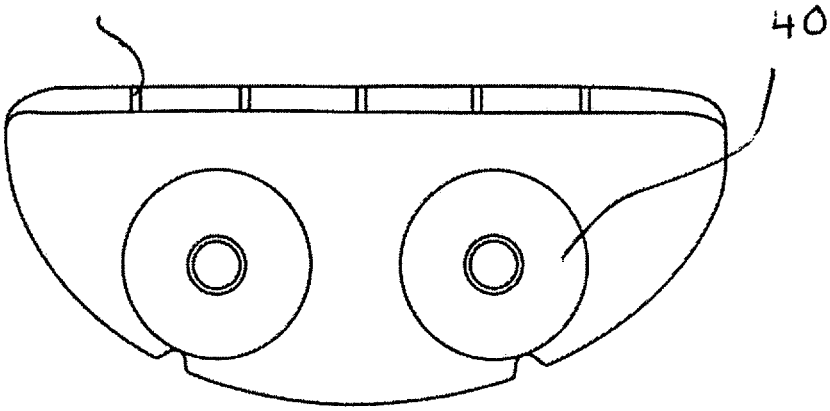
FIG. 22 is a bottom view of an alternate embodiment guitar armrest body.

Between the guitar rest's top face 8 and its bottom face 10 are at least two stepped through bores 12 through which the neck 14 of a suction cup 6 is frictionally constrained. (FIGS. 11 and 12) The suction cups 6 are made of a lower durometer material and are a standard 1¾ inch diameter commercially available suction cups Formed through the body 4 and equally spaced on either side of the axial centerline are two stepped bores 12 (FIGS. 12 and 14). The largest diameters 42 of these stepped bores 12 open from the concave bottom inner face 10 and the smallest diameters 44 of these stepped bores 12 open from the top outer face 8. The concave bottom, (inner) face 10 of the body 4 has 2 identical concave depressions 40 formed thereon and centered about the stepped bores 12. These stepped bores 12 frictionally retain the two suction cups 6 by their necks 14 therein. The smaller diameters 44 of the stepped bores 12 in the top face 8 of the body 4 is less than the diameter of suction buttons 48 of the suction cups 6, preventing the suction cup 6 from dislodging from the body 4.

The suction cups 6 are made of a flexible, polymer circular disk with a concave lower face having a circular perimeter with a suction release tab 30 extending therefrom. Centrally located at the apex 50 of the circular disk is a suction button 48 that has a two diameter stepped neck 14 capped by a suction button 14. The suction button 48 has a diameter that is larger than the smaller diameter 44 of the stepped bore 12. Because of the 60-65 durometer rating of the body 4, the buttons 48 may be placed with their convex top face 52 adjacent the concave depressions 40 and their buttons 48 pressed through the stepped bores 12, stretching the diameter of the stepped bores 12 to accommodate the passing of the buttons 48. Once the suction button 48 has extended through the stepped bore 12 and protrudes beyond the top face 8 of the body 4, the suction cup 6 is trapped in the thickness of the body 4, although it is free to elastically deform, collapse and pull a vacuum on any planar surface upon the depressing of the suction buttons 48. The suction cups 6 are of a conventional design and a stock, commercially available size of 1¾". This allows the replacement of damaged or failing suction cups 6.

Looking at FIGS. 13-18, with the suction cups 6 removed from the body 4 9, 10, 11 and 12 one can more clearly see the stepped bores 12, concave depressions 40, suction release notches 28. It is to be noted that when the suction cups 6 are engaged into the body 4, the suction cups 6 reside in the two identical concave depressions 40 formed under the stepped bores 12 such that the bottom of the suction cup 6 is even or just slightly above the remainder of the bottom inner face 10. In this way the positioning is not hampered by the friction of the suction cups 6 on the guitar side, and when the suction button 48 is depressed the suction cups 6 pull the bottom inner face 10 into frictional contact with the guitar side 24.

Looking at FIGS. 11 and 25-28 it can be seen that the side 24 and the soundboard 26 of the guitar meet at approximately 90 degrees, although some soundboards may be slightly domed having radiuses up to the 25 foot range bringing the intersection to between 90 and 91 degrees. The guitar armrest 2 resides with its concave bottom inner face 10 in contact with the side 24 of the acoustic guitar in the lower guitar bout region downstream of the fretboard 60. Because of the flexibility of the 60-65 durometer rubber armrest 2 it will be able to contour (if necessary) to the curvature of the guitar's side 24. (With more radically sized or shaped guitars the alternate embodiment slotted guitar armrest may be employed.) The intersection of the inner face of the arced front panel 16 and the concave bottom inner face 10 forms an arc and the included obtuse angle between the bottom inner face 10 and the front panel 16 is approximately 95 degrees. ("Approximately" denoting fabrication with a tolerance of +5 degrees and −2 degrees.) The interface 80 between the inner faces of the two panels 5 and 16, is approximately 95 degrees. When the suction buttons 48 are depressed they contact the side 24 of the guitar and their concave bodies deform to expel the air under the concavity until a suction bond is created. This keeps the armrest 2 from moving on the guitar 1 but most importantly keeps the 90 degree edge of the guitar 1 located at the intersection of the inner face 11 of the arced front lip panel 16 and the concave bottom inner face 10 of the top panel 5. In this way the front lip panel 16 does not contact the soundboard 26 and prevent it from projecting music. In fact, the 95 degree flair out from the soundboard keeps the guitarist's arm from contacting the soundboard as well. Thus, the armrest 2 not only alleviates stress on the guitarist's arm, it actually eliminates the partial muting of the projected sound. The soundboard is free to vibrate and pump air/sound unhampered.

Looking at FIGS. 19-24 it can be seen that the alternate embodiment body 70 differs only from the body 4 of the preferred embodiment only by the introduction of a series of V notches 72 formed partially into the front lip panel 16 from its outer peripheral edge up to the bottom inner face 10. These notches are widest at the outer peripheral edge and can thus close to accommodate more flexion along the linear axis of the body 4 to increase its curvature for different shaped guitars or placement at a differ position on the guitar 1.

Looking at FIGS. 11 and 25-28 one can best understand the novelty of the design of the acoustic guitar armrest 2. The 95 degree included angle between the concave bottom inner face 10 and the inner face of the front panel 16, combined with the rest's rubber construction in the specified durometer range of 60-65 on the Shore A scale of hardness, and the radius formed on the outer face of the front panel 16 where it interfaces with the convex top face 8, synergistically enables the following novel features that are not found in any of the prior art guitar armrests.

It allows the rest to contour (if necessary) to the curvature of the side 24 of different shaped guitars to minimize slippage and increase user comfort.

It allows the front panel 16 to be kept off of the guitar soundboard to prevent scratching the guitar or affecting its sound frequencies.

It will not slide along the side of the guitar.

Most importantly, it creates an edge at the top/front panel interface that is not sharp enough to cut off the flow of blood to the guitarist's arm.

It is envisioned that the guitar armrest 2 will be fabricated in various colors other than the conventional black, to compliment the guitar it is used on.

While certain features and aspects have been described with respect to exemplary embodiments, one skilled in the art will recognize that numerous modifications are possible. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. An armrest for an acoustic guitar comprising:

a unitary single piece constructed domed polymer disk with a top panel having a concave bottom face and a convex top face with a top arc that contours to the curvature of a side of a guitar body; and a front panel that extends over the soundboard of a guitar with an outer face, an inner face and an arced front edge to prevent the cut off the flow of blood to a guitarist's arm, said arced front edge parallel with said top arc, and to protect said soundboard from damage;

wherein said front panel extends from said concave bottom face over the soundboard of said guitar, with an included obtuse angle of 95 degrees formed between said concave bottom face of said top panel and said inside face of said front panel so as to prevent a guitarist's arm or said front panel from contacting the soundboard and hampering the projection of air and sound from the soundboard, as well as eliminating the 90 degree pressure point on the guitarist's arm that occurs at the intersection of the guitar's sidewall and soundboard, and fitting over guitars with greater than 90 degree side wall to soundboard interfaces; and at least one suction cup removably affixed to said disk, said suction cup having a domed configuration.

2. The armrest of claim 1 further comprising:

at least one stepped bore formed through said disk extending between said convex top face, and said concave bottom face;

at least one concave depression formed in said concave bottom face, centered about said at least one stepped bore, said at least one concave depression matingly conformed to receive said domed configuration of said at least one suction cup; and with an included obtuse angle of 95 degrees formed at the interface between said concave bottom face of said top panel and said inside face of said front panel.

3. The armrest of claim 2, further comprising:

a suction button poised above an apex of said at least one suction cup, said suction button connected to said at least one suction cup by a neck, said neck having a diameter less than a diameter of said suction button and less than a diameter of said at least one stepped bore, wherein said diameter of said suction button exceeds said diameter of said at least one stepped bore.

4. The armrest of claim 3, further wherein said neck is frictionally engaged in said at least one stepped bore and said suction button extends above said convex top face, and wherein said at least one suction cup has a bottom circular perimeter that resides in said concave depression above said concave bottom face.

5. The armrest of claim 4, wherein said semi-circular domed polymer disk has a perimeter with at least one suction release notch formed there along, and wherein said at least one suction cup has a suction release tab extending therefrom and positioned to extend from beyond said at least one suction release notch.

6. The armrest of claim 1, wherein said armrest is fabricated from a rubber and has a hardness in the range of 60 to 65 on the Shore A durometer scale such to allow said front panel to flex but not contact said soundboard of said guitar but enough to deform said at least one stepped bore for the passage of said suction button.

7. The armrest of claim 6, further comprising:

at least on V notch formed in said arced front panel.

8. The armrest of claim 1, further comprising:

at least one V notch of removed material removed from formed in said arced front panel.

9. An armrest for an acoustic guitar that contours to the curvature of a side of a guitar body, extends over the guitar's soundboard, and prevents the armrest from moving on said side of guitar body, comprising:

a domed polymer disk with a top panel having a concave bottom face and a convex top face with a top arc;

a front panel with an outer face, an inner face and an arced front edge parallel with said top arc, wherein said front panel extends from said concave bottom face over a guitar's soundboard, with an included obtuse angle of 95 degrees formed between said concave bottom face of said top panel and said inside face of said front panel to prevent the cut off the flow of blood to a guitarist's arm, to prevent said guitarist's arm and said armrest from contacting said soundboard and affecting the volume and sound projected from said soundboard, and to allow the armrest to fit over guitars with domed soundboards; and at least one suction cup removably affixed to said disk, said suction cup having a domed configuration; and wherein said armrest is fabricated from a polymer having a hardness in the range of 60 to 65 on the Shore A durometer scale.

* * * * *